US011692335B2

(12) United States Patent
McAlpine et al.

(10) Patent No.: US 11,692,335 B2
(45) Date of Patent: Jul. 4, 2023

(54) SANITARY APPLIANCE DRAIN CONNECTOR

(71) Applicant: McAlpine & Co. Ltd., Glasgow (GB)

(72) Inventors: James Edward McAlpine, Paisley (GB); Robert Gemmell McAlpine, Glasgow (GB)

(73) Assignee: McAlpine & Co. Ltd., Glasgow (GB)

( * ) Notice: Subject to any disclaimer, the term of this patent is extended or adjusted under 35 U.S.C. 154(b) by 0 days.

(21) Appl. No.: 16/976,432

(22) PCT Filed: Mar. 11, 2019

(86) PCT No.: PCT/GB2019/050667
§ 371 (c)(1),
(2) Date: Aug. 27, 2020

(87) PCT Pub. No.: WO2019/175554
PCT Pub. Date: Sep. 19, 2019

(65) Prior Publication Data

US 2021/0002876 A1 Jan. 7, 2021

(30) Foreign Application Priority Data

Mar. 15, 2018 (GB) ..... 1804150

(51) Int. Cl.
*E03C 1/20* (2006.01)
*E03C 1/182* (2006.01)

(52) U.S. Cl.
CPC ..... *E03C 1/20* (2013.01); *E03C 1/182* (2013.01)

(58) Field of Classification Search
CPC ..... B25B 13/02; B25B 13/48
See application file for complete search history.

(56) References Cited

U.S. PATENT DOCUMENTS 3,913,928 A 10/1975 Yamaguchi
4,497,511 A 2/1985 Barker
(Continued)

FOREIGN PATENT DOCUMENTS

AU 595954 B2 5/1988
CN 107620846 1/2018
(Continued)

OTHER PUBLICATIONS

"Chinese Application Serial No. 201980018477.3, Office Action dated Mar. 10, 2021", w/ English Translation, 21 pgs.
(Continued)

*Primary Examiner* — Erin Deery
(74) *Attorney, Agent, or Firm* — Schwegman Lundberg & Woessner, P.A.

(57) ABSTRACT

A drain connector (10) is configured to be installed with a sanitary appliance (100) from bottom-up. The drain connector (10) includes a main body (12) connectable at a first end to an inlet end of a waste pipe system or trap. A hollow stalk member (14) is received at least partially within the main body (12). The hollow stalk member (14) is arranged to extend and retract relative to the main body (12) via a second end of the main body (12). The drain connector (10) includes at least one sealing element (24) defining an interference and active sealing fit between the main body (12) and the hollow stalk member (14). The hollow stalk member (14) is configured to slide relative to the main body (12) thereby extending the height of the drain connector (10) and thereby facilitating connection of an exposed end of the hollow stalk member (14) to an outlet of the sanitary appliance (100), wherein the end of the hollow stalk member (14) is retrievable and extendable from the main body (12) via the outlet of the sanitary appliance.

14 Claims, 4 Drawing Sheets

(56) References Cited

U.S. PATENT DOCUMENTS

| | | | | |
|---|---|---|---|---|
| 5,090,276 | A * | 2/1992 | Groskey | B25B 13/02 81/436 |
| 5,893,396 | A * | 4/1999 | Vagle | E03C 1/324 138/155 |
| 7,963,197 | B2 * | 6/2011 | Starko | B25B 13/48 81/177.2 |
| 10,006,577 | B2 | 6/2018 | Meister et al. | |
| 2007/0057502 | A1 * | 3/2007 | Shafik | E03C 1/232 285/121.3 |

FOREIGN PATENT DOCUMENTS

| | | | |
|---|---|---|---|
| GB | 1385248 | A | 2/1975 |
| WO | WO-2006/043301 | A2 | 4/2006 |

OTHER PUBLICATIONS

"International Application Serial No. PCT GB2019 050667, International Preliminary Report on Patentability dated Sep. 15, 2020", 9 pgs.

International Application No. PCT/GB2019/050667, Search Report and Written Opinion dated Jun. 19, 2019, 11 pgs.

* cited by examiner

SANITARY APPLIANCE DRAIN CONNECTOR

This application is a U.S. National Stage Filing under 35 U.S.C. 371 from International Application No. PCT/GB2019/050667, filed on Mar. 11, 2019, and published as WO 2019/175554 A1 on Sep. 19, 2019, which claims the benefit of priority under 35 U.S.C. § 119 to United Kingdom Patent Application No. 1804150.9, filed on Mar. 15, 2018, each of which is incorporated by reference herein in its entirety.

FIELD OF THE INVENTION

The present invention relates to the field of freestanding bathtubs and improving installation. In particular, the present invention relates to a concealed drainage connector which connects from bottom-up to a sanitary appliance, for example a drain outlet of a freestanding bathtub.

BACKGROUND TO THE INVENTION

A freestanding bath tub is a desire for many because it provides a clean and uncluttered look in modern bathrooms. It is desirable to have freestanding appliances, but it is not desirable for the waste outlet or associated pipework to be visible when the appliance is installed.

Typically, installing a freestanding bathtub requires connection of a pipe connection (tailpiece) to a drain outlet of an upturned bathtub before connecting to a pipe or trap beneath the floor.

When the bathtub is upturned a tailpiece, typically in brass, is aligned with the drain outlet and is secured and sealed against the exposed underside of the bathtub about the drain outlet of the bathtub. After the tailpiece is secured, the orientation of the bathtub is restored to the upright position and the bathtub is maneuvered into alignment with another pipe connection, drain connection or trap located beneath the floor. Upon lowering the bathtub towards the floor the tailpiece is received in the pipe connection, drain connection or trap located beneath the floor. This arrangement of the tailpiece and the drain connection facilitates drainage of water from the bathtub after use.

Safe handling of a bathtub in this situation, usually involves two people to lift and upturn the bathtub, to restore the bathtub to the upright position and to align the pipe connection with a subfloor pipe or trap. It will be appreciated that it is essential to ensure that the tailpiece is the correct length prior to installation to ensure proper engagement with the drain connection and to avoid the need to cut the tailpiece during installation.

It will be appreciated upturning and general handling of the bathtub may lead to damage to the bathtub, in particular the drain outlet if careful handling is not adhered to or in the event of accidental dropping of the bathtub. Injury to the installer is possible due to mishandling or loss of balance whilst turning or restoring the orientation of the bathtub.

SUMMARY OF THE INVENTION

A first aspect of the present invention provides a drain connector configured to be installed with a sanitary appliance from bottom-up, wherein the drain connector comprises:

a first hollow body connectable at a first end to an inlet end of a waste conduit;

a second hollow body received at least partially within the first hollow body, wherein the second hollow body can extend and retract relative to the first hollow body via a second end of the first hollow body;

at least one sealing element defining an interference and active sealing fit between the first hollow body and the second hollow body;

wherein the second hollow body is configured to slide relative to the first hollow body thereby extending the height of the drain connector and thereby facilitating connection of an exposed end of the second hollow body to an outlet of the sanitary appliance, wherein the end of the second hollow body is retrievable and extendable from the first hollow body via the outlet of the sanitary appliance.

Bottom-up installation relates to the assembly of the first and second hollow connectors being installed beneath a sanitary appliance, for example a bathtub and the installation being completed by retrieving the end of the second hollow connector and pulling upwards from (from bottom) to connect with the outlet of the sanitary appliance.

The first hollow body may comprise an internally stepped tubular body, wherein a first, step acts as a stop for the second hollow body and a second step supports the at least one sealing element.

The first hollow body may comprise an annular closure member at one end wherein the closure member and the second step contain the at least one sealing element therebetween.

The at least one sealing element may comprise a fin seal including a flexible element having a free end and being anchored at one end to an annular body, wherein the free end can be displaced and deformed by action of the second hollow member relative to the first hollow member thereby creating and maintaining an active seal between the first hollow member and the second hollow member.

An open end of the first hollow body may facilitate docking the drain connector to an inlet end of a waste conduit.

The sealing element may comprise two flexible elements. Alternatively, the sealing element may comprise two or more fin seals. An annular spacer may be sandwiched between each fin seal.

The second hollow member may comprise an elongated tubular body, including an annular connector at the exposed end.

The annular connector may include a recessed upper rim which is configured to receive a sealing member, for example an O-ring.

The O-ring is operable to ensure sealing contact between the second hollow member and the exterior surface of the installed sanitary appliance, for example a bathtub.

The drain connector may further comprise an extraction tool configured for attachment to the exposed end of the second hallow member thereby aiding extraction or retraction of the second hollow member relative to the first hollow member.

The second hollow member and the extraction tool may each comprise complementary fasteners to facilitate connection of the second hollow member to the extraction tool, such that the second hollow ember and the extraction tool move as a unit relative to the first hollow body.

The second hollow member may comprise at least two radially projecting lugs and the extraction tool may comprise at least two L-shaped slots, wherein each L-shaped slot includes an open leg and a closed leg wherein each lug can be locate into a mouth of the open leg, inserted into the open leg until the lug aligns with a mouth of the closed leg rotates along the closed leg to lock the lug against a closed end of the closed leg.

The drain connector may further comprise a drain key, which facilitates securing a drain flange to the exposed end of the second hollow member. The drain key may be defined by a hollow sleeve configured to be received over at least part of the extraction tool.

The extraction tool may comprise at least a portion of the tool body having an external cross-sectional dimension smaller than an internal cross-sectional dimension of the drain key such that the drain key can be received over the portion of the extraction tool body.

An exposed end of the extraction tool may include a textured surface, which facilitates gripping and holding the extraction tool during installation and removal.

An external surface of the drain key may be profiled to correspond with a profile of an internal surface of a drain flange such that during installation the corresponding surfaces of the drain key and the drain flange engage and rotate as a unit relative to the extraction tool.

A further aspect of the present invention provides a bottom-up method of installing a sanitary appliance, the method comprises the steps:

- installing a drain connector to an inlet end of a waste unit, wherein the drain connector comprises an extractable hollow body configured such that an exposed end of the hollow body is connectable to a waste outlet of the sanitary appliance;
- locating a sanitary appliance over the drain connector such that an outlet of the sanitary appliance aligns with the exposed end of the extractable hollow connector;
- extracting at least part of the extractable hollow connector via the waste outlet of the sanitary appliance; and
- connecting the exposed end of the extractable hollow connector to a drain flange via the waste outlet of the sanitary appliance.

The method may comprise a step of inserting an extraction tool via the waste outlet of the sanitary appliance and connecting the extraction tool to the exposed end of the extractable hollow body, wherein connecting the extraction tool to the exposed end of the extractable hollow body precedes and facilitates the step of extracting at least part of the extractable hollow connector via the waste outlet of the sanitary appliance.

The method may further comprise inserting a drain key and connecting the drain key to the drain flange and rotating the drain key and the drain flange as a unit relative to exposed end of the extractable hollow member thereby connecting and securing the drain flange and the extractable hollow member about the outlet of the sanitary appliance.

The method may further comprise removal of the extraction tool.

The method may further comprise removal of the drain key.

The method may further comprise removal of the drain key and the extraction tool as a unit. The relative dimensions of the extraction tool and the drain key may be such that extraction as a unit is possible following installation of the sanitary appliance.

The bottom-up installation technique reduces the occurrence of leaks during installation because the installation and manufacturing steps are reduced compared with known installation processes.

The bottom-up installation method facilitates installing and connecting the drain connector as a single unit to a trap or waste pipe located beneath the sanitary appliance, e.g. a bathtub.

BRIEF DESCRIPTION OF THE DRAWINGS

Embodiments of the present invention are described below, by way of example only, with reference to the accompanying drawings, in which.

DESCRIPTION

Figure 1:
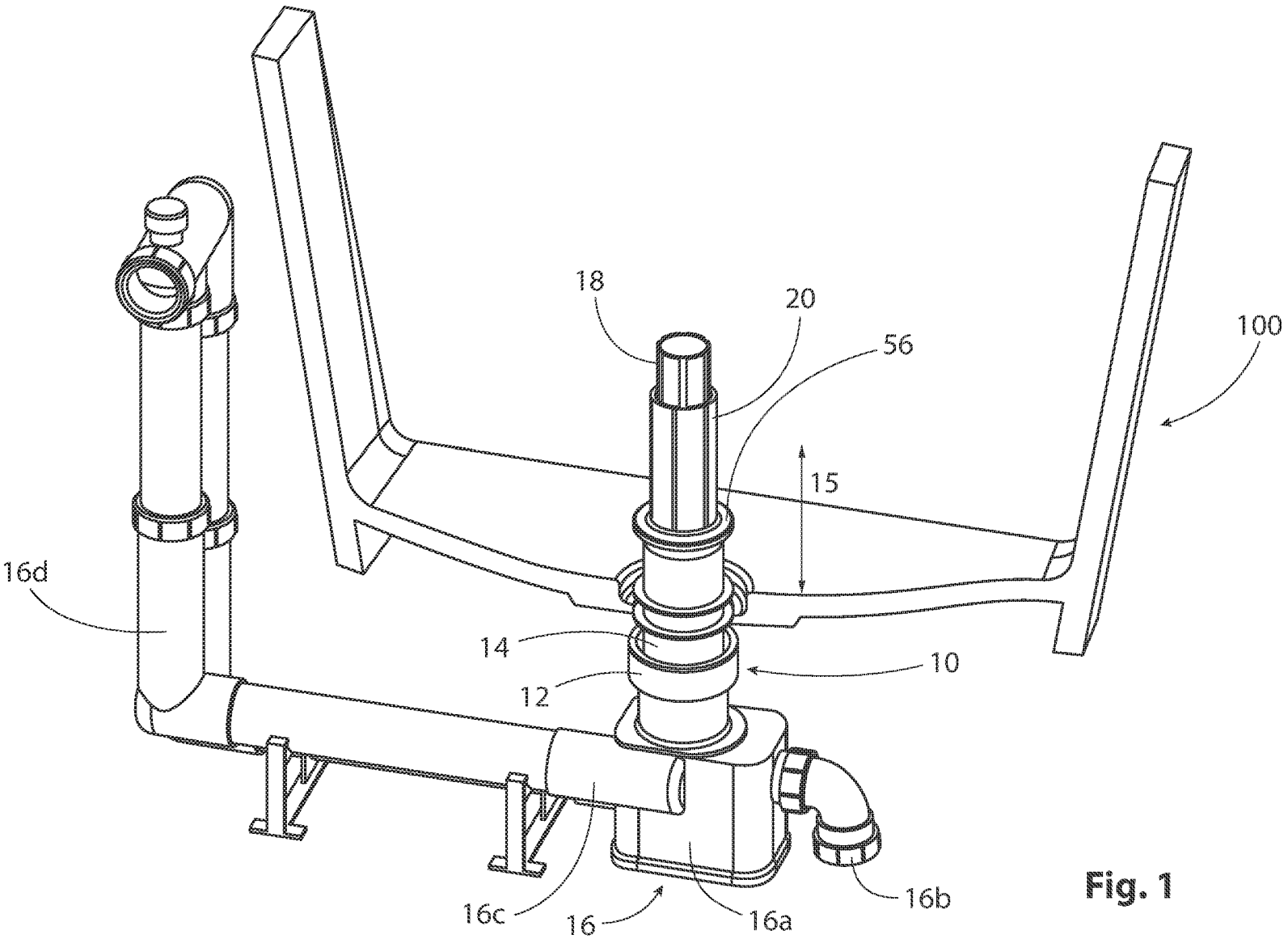
FIG. 1 is a schematic representation of a partial installation of a free-standing bathtub and a drain connector according to an embodiment of the present invention.

FIG. 1 illustrates a schematic representation of a partial installment of a drain connector 10 and a freestanding bathtub 100.

In the illustrated example, the drain connector 10 includes an assembly of a main body 12 and a hollow stalk member 14, where the hollow stalk member 14 telescopically extends from and retracts into the main body 12, as indicated by arrow 15.

In use, the main body 12 facilitates docking the drain connector 10 to a subfloor waste pipe system 16. For example, the main body 12 connects to a trap 16*a* (as illustrated) or directly to a waste pipe beneath the floor on which the bathtub 100, or other sanitary appliance, is to be installed.

A box trap 16*a* is illustrated. However, it will be appreciated other traps, for example P-trap, Strap etc. may be used. In the illustrated example, the trap 16*a* includes a waste outlet 16*b* and an outlet 16*c* connected to an external and concealed overflow system 16*d*. The trap 16*a* and the concealed overflow system 16*d* are included for illustrative purposes only.

Figure 2B:
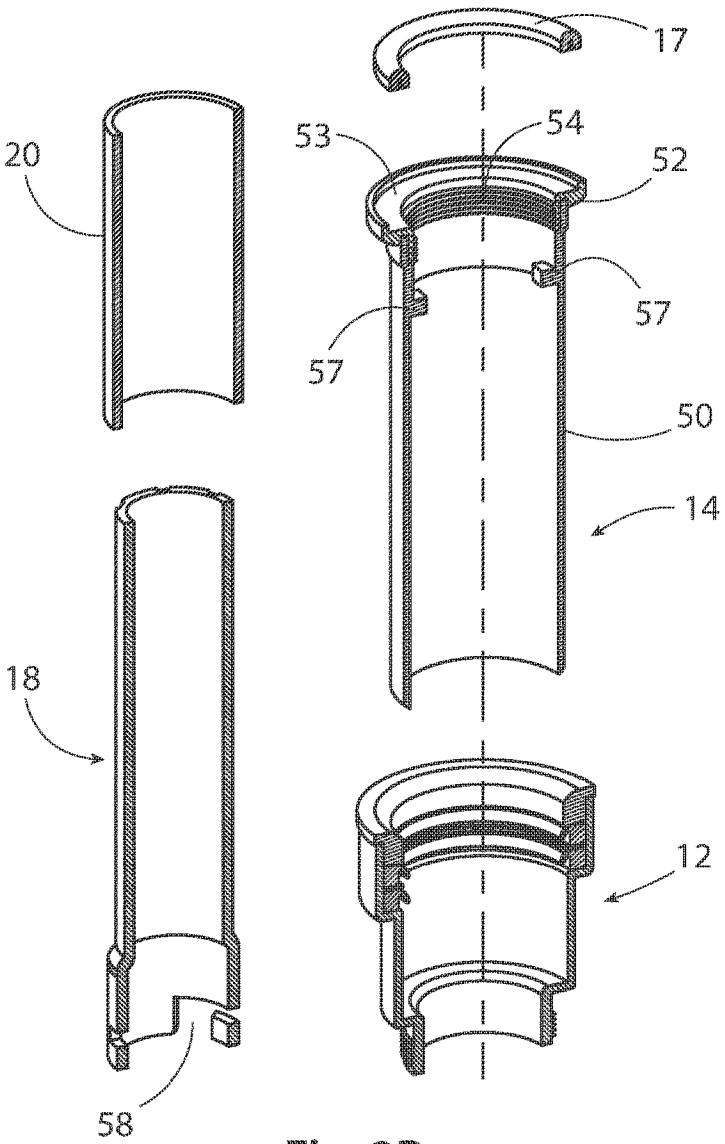
FIG. 2B is a schematic representation of an exploded partial view of a drain connector as illustrated in FIG. 1.
Figure 2A:
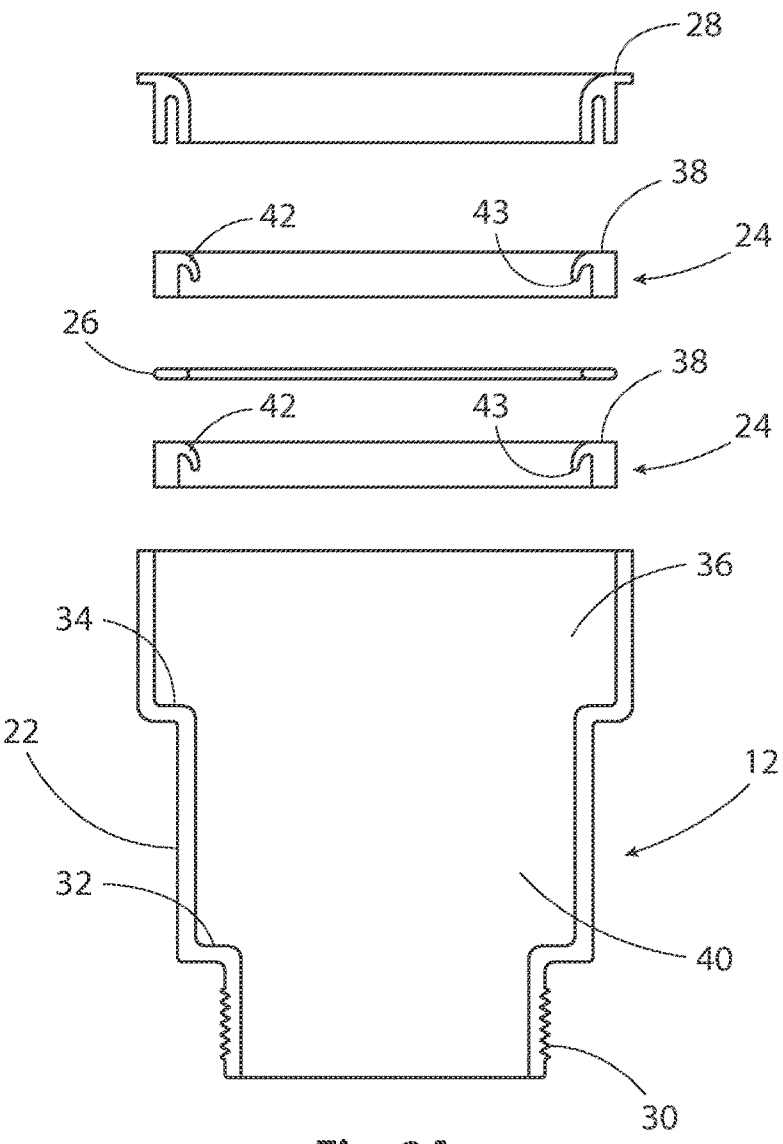
FIG. 2A is a schematic representation of an exploded view of a main body of a drainage connector according to an embodiment of the present invention.

FIG. 2A illustrates an exploded view of the main body 12.

FIG. 2B illustrates an exploded partial view of a drain connector 10, which includes a partial view of the assembled main body 12, the hollow stalk member 14, an O-ring seal 17, a keyed tool 18 and a drain key 20. Each of these components will be described further below.

Figure 3B:
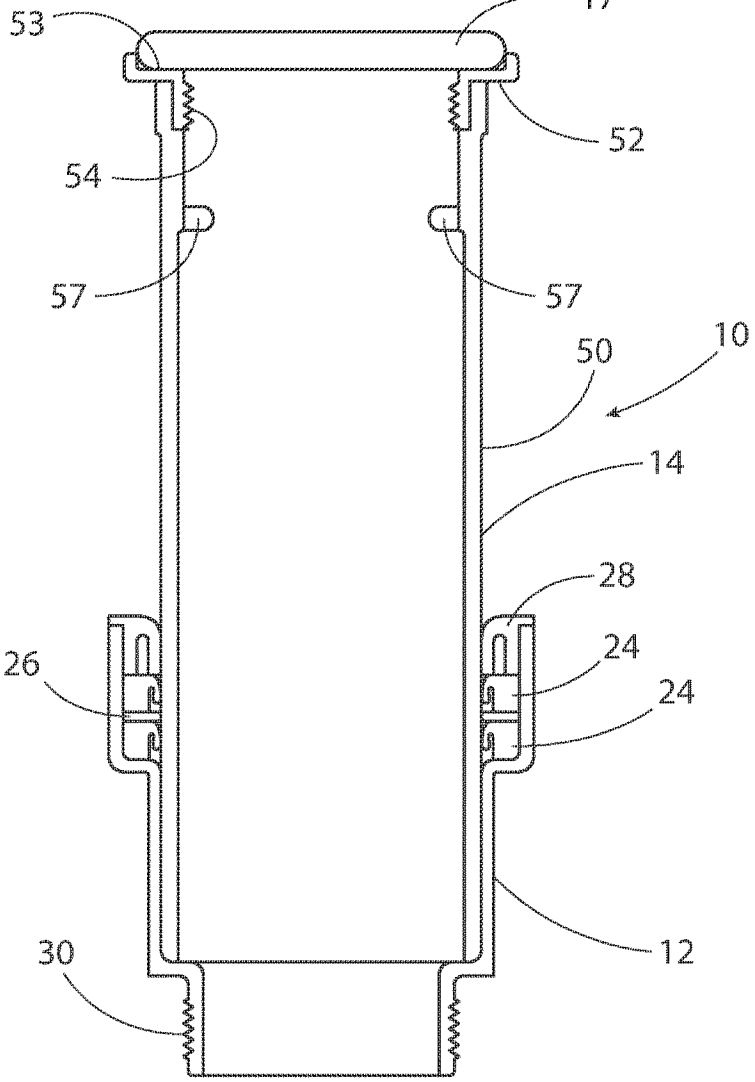
FIGS. 3A and 3B is a schematic representation of an assembled drain connector as illustrated in FIG. 1.
Figure 3A:
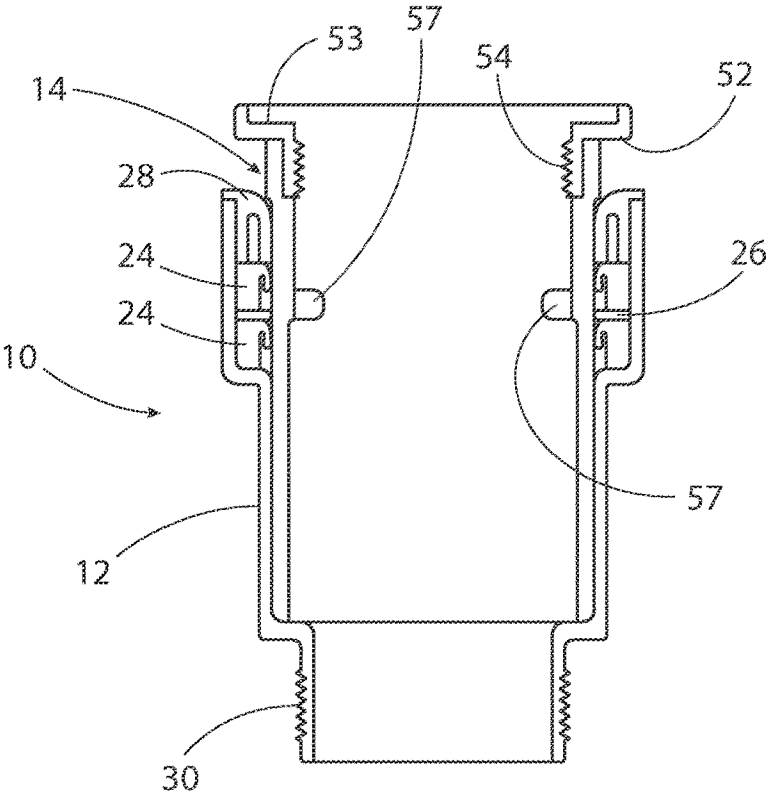

Referring to FIGS. 2A, 3A and 3B, the main body 12, includes an assembly of an internally stepped tubular body 22, two annular fin seals 24, a spacer washer 26 and an annular cap 28.

In the illustrated example, the stepped tubular body 22 includes a threaded open end 30, which facilitates docking the main body 12 to the trap 16*a* (see FIG. 1).

In the illustrated example, two steps 32, 34 are included on the inside surface of the tubular body 22. The first, lower, step 32 acts as a stop for the hollow stalk member 14, which is described further below with reference to FIGS. 2B, 3A and 3B.

The second, upper, step 34 and the annular cap 28 act to retain the fin seals 24 and spacer washer(s) 26 therebetween and within an upper section 36 of the tubular body 22.

In the illustrated example, the upper section 36 of the tubular body 22 is configured to contain two annular fin seals 24 and a spacer washer 26, which is sandwiched between the two fin seals 24. The spacer washer 26 accommodates flexing and adjustment of the fin seals 24 during installation and dismantling.

The fin seals 24 each contain an annular body 38 having an internal diameter slightly greater than the diameter of the mid-section 40 of the tubular body 22.

The fin seals 24 also include an annular fin 42, which provides an active sealing member. The annular fin 42 is defined by a flexible element which is anchored at one end to the annular body 38 and is free at the opposite end i.e. the free end 43 can be displaced and deformed. The free end 43 of the flexible element protrudes radially inwards such that upon insertion of the hollow stalk member 14 the free end 43 is displaced radially outwards, whilst maintaining contact with the hollow stalk member 14.

The flexible element (annular fin) includes resilience, and acts as an active seal, such that upon insertion of the hollow stalk member 14 an interference fit and active seal is created and maintained between the main body 12 and the hollow stalk member 14.

The resilience and deformability of the flexible element/annular fin 42 ensures that an interference fit is maintained whilst the hollow stalk member 14 is extended or retracted relative to the main body 12 and whilst the hollow stalk member 14 is stationary i.e. in the installed position. This arrangement ensures that a watertight connection is established and maintained between the main body 12 and the hollow stalk member 14.

The mid-section 36 of the main body 12 is an elongated hollow section, which houses a lower portion of the hollow stalk member 14 (FIGS. 2B, 3A and 3B) and facilitates extension and retraction of the hollow stalk member 14 during installation of a bathtub 100.

In the illustrated example (see FIGS. 2B, 3A and 3B) the hollow stalk member 14 includes an elongated tubular body 50 with an annular connector 52 at the upper end. The illustrated annular connector 52 includes a recessed upper rim 53, which receives the O-ring 17 (omitted from FIG. 3A) to ensure sealing contact between the hollow stalk member 14 and the exterior surface of the installed bathtub.

The body of the annular connector 52 includes an internal thread 54 which engages with a complementary external thread provided on a drain flange 56 (see FIG. 1) inserted from the inside of the bathtub.

FIG. 3A and FIG. 3B illustrate different lengths of hollow stalk member 14. It will be appreciated that the length of the hollow stalk member 14 will be dictated by the space between the main body 12 and the exterior surface of the bathtub.

The hollow stalk member 14 includes two engaging lugs 57 extending radially inwards. The engaging lugs 57 are configured to engage with the keyed tool 18 (see FIG. 2B and FIG. 4) to facilitate connection of the drainage connector 10 to the bathtub.

Figure 4:
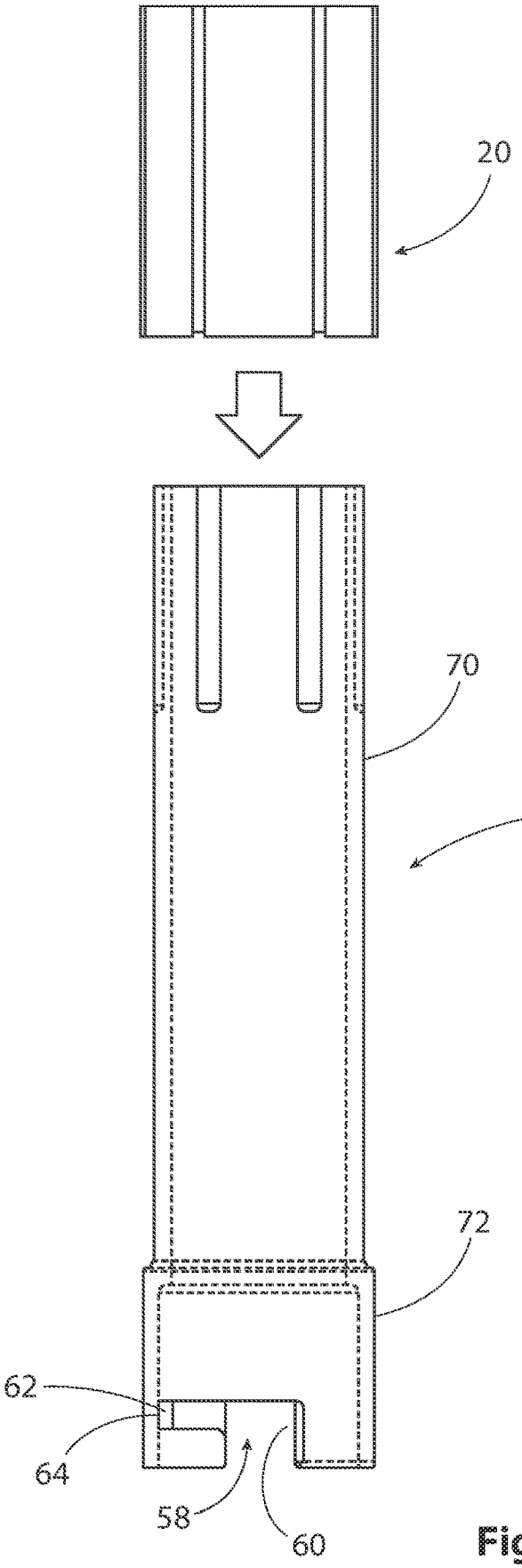
FIG. 4 is a schematic representation of keyed tool and drain key for use with the drain connector and bathtub installation illustrated in FIG. 1.

Referring to FIGS. 2B and 4, in the illustrated example, the keyed tool 18 includes two diametrically opposed L-shaped slots 58 which engage with the lugs 57. The L-shaped slots 58 each include an open leg 60 and a closed leg 62, which facilitate a "locate, insert, locate and turn" arrangement to lock together the keyed tool 18 and the hollow stalk member 14 such that they can be displaced as a unit to connect the drainage connector 10 and the bathtub.

The "locate, insert, locate and turn" arrangement includes locating/aligning the lug 57 into the mouth of the open leg 60, inserting the lug 57 into the open leg until the lug 57 is aligned/located with the mouth of the closed leg 62 and turning the keyed tool 18 such that the lug 57 locks against the closed end 64 of the closed leg 62.

In the illustrated example, the keyed tool 18 includes an external stepped profile, wherein an upper section 70 of the tool 18 has a smaller diameter than a lower, engaging, section 72 of the keyed tool 18.

The upper section 70 includes a textured/fluted surface 73, which facilitates gripping of the keyed tool 18 during installation and removal of the keyed tool 18 after installation.

A drain key 20 is illustrated in FIGS. 1 and 4. During installation, the drain key 20 facilitates securing the drain flange 56 (the finished drain part that is visible inside the bathtub) to the hollow stalk member 14.

In the illustrated example, the drain key 20 is a hollow sleeve, having an internal diameter smaller than the outer diameter of the upper section 70 of the keyed tool 18. The relative dimensions of the drain key 20 and the keyed tool 18 are such that the drain key 20 can be received over the upper section 70 of the keyed tool 18.

The upper section 70 of the keyed tool 18 facilitates gripping and holding the hollow stalk member 14 against the exterior surface of the bath tub, whilst the drain key 20 is rotated relative to the upper section 70 of the keyed tool 18 to engage and tighten the drain flange 56 and the hollow stalk member 14.

In the illustrated example, the external circumference of the drain key 20 is fluted to correspond with a fluted internal circumference of the drain flange 56 such that during installation the corresponding surfaces of the drain key 20 and the drain flange 56 engage and rotate as a unit relative to the upper section 70 of the keyed tool 18.

Rotation of the drain key 20 relative to the upper section 70 of the keyed tool 18 connects and secures the drain flange 56 to the internal thread 54 provided at the upper end of the hollow stalk member 14.

It will be appreciated, that securing the drain flange 56 to the threaded end 54 of the hollow stalk member 14 compresses and sandwiches the seal 17 against the exterior surface of the bathtub and the recessed upper rim 53 to provide a watertight seal at the outlet of the bathtub.

Installation of a bathtub using the drain connector 10 described above uses a bottom-up assembly technique. However, current installation processes use a top-down installation process. The top-down installation process typically involves upturning the bathtub and attaching a hollow stalk member element to the outlet of the bathtub and a drain flange. Once the drain flange and hollow stalk element are secured the bathtub is restored to its upright position, whilst aligning the hollow stalk element with a drain shoe, pipe, trap or adapter in the floor below the bathtub.

The method of installing a sanitary appliance, in particular a freestanding bathtub, using the drain connector 10 and the keyed tool 18 described above, with reference to FIGS. 1 to 4, simplifies and speeds up the installation process compared with current practice. The bottom-up installation technique also reduces the chance of leaks because the installation and manufacturing steps are reduced.

The bottom-up installation technique requires installing and connecting the drain connector 10 as a single unit to a trap 16*a* or waste pipe located beneath the bathtub, in the location the bathtub is to be installed. Installation of the drain connector 10 is typically via a void or a hole in the floor.

Subsequently, the bathtub is positioned such that the drain connector 10 and the outlet of the bathtub are aligned to allow insertion of the keyed tool.

The keyed tool 18 can be provided as part of the drain connector 10 and removed after installation or the keyed tool can be inserted after the bathtub is aligned with the drain connector 10 for installation.

As noted above the keyed tool 18 is connected to the hallow stalk member 14 by "locating, inserting, locating and turning" the keyed tool 18 relative to the lugs 57 in the hollow stalk member 14.

Once the keyed tool 18 and the hollow stalk member 14 are locked together the keyed tool 18 is used to raise/extract part of the hollow stalk member 14 relative to the main body 12. The hollow stalk member 14 is raised until the open/free end of the upper section of the hollow stalk member 14 engages with the underside of the bathtub. At this point the drain flange 56 is applied from the internal side of the outlet of the bathtub to engage and secure the seal 17 between the bathtub and the rim 53 at the upper section of the hollow stalk member 14.

A drain key 20 as described can be used to install the drain flange 56. As described above using the drain key 20 facilitates rotation of the drain flange 56 as a single unit to simply and efficiently connect the drain connector 10 to a bathtub with minimal effort.

It will be appreciated that removal of the bathtub utilises a reverse process to the method described above. To remove the bathtub, for example for maintenance, replacement or for inspection of the sub floor waste drain system, the keyed tool 18 is inserted through the drain outlet of the bathtub and is locked to the hollow stalk member 14 by "locating, inserting, locating and turning" the keyed tool 18 relative to the lugs 57 in the hollow stalk member 14.

Once locked together, the hollow stalk member 14 is rotatable to detach it from the drain flange 56. The drain key 20 (if required) can be inserted and connected with the drain flange 56 to allow rotation of the drain flange 56 relative to the hollow stalk member 14 to detach the hollow stalk member 14 from the drain outlet. This simple reverse process allows for easy dismantling and removal of the bathtub.

Whilst specific embodiments of the present invention have been described above, it will be appreciated that departures from the described embodiments may still fall within the scope of the present invention.

The invention claimed is:

1. A drain connector unit configured to be installed with a sanitary appliance from bottom-up, wherein the drain connector unit is configured such that it can be fitted to the appliance, when the appliance is in an upright orientation; the drain connector unit comprises:

a first hollow body and a second hollow body, wherein a first end and a lower portion of the second hollow body is housed in the first hollow body and a second exposed end of the second hollow body facilitates sliding the second hollow body telescopically relative to the first hollow body to lengthen or shorten the drain connector unit, wherein, in use, a second end of the second hollow body connects to an outlet of the sanitary appliance; and at least one sealing element contained within the first hollow body, wherein the at least one sealing element defines an interference and active sealing fit between the first hollow body and the second hollow body;

wherein the first hollow body includes an internal first step acting as a stop for the second hollow body in a fully retracted position and an internal second step configured to support the at least one sealing element;

wherein, in use, the drain connector unit is connectable to a sub-floor waste conduit, wherein a first end of the first hollow body is connectable to an inlet end of the sub-floor waste conduit before positioning the sanitary appliance above the drain connector unit and before connecting the drain connector unit to the sanitary appliance, wherein the second end of the second hollow body is retrievable and extendable from the first hollow body via the outlet of the sanitary appliance thereby extending the height of the drain connector unit and thereby facilitating connection of the second end of the second hollow body to the outlet of the sanitary appliance, wherein, in use, the drain connector unit facilitates bottom-up in-situ connection of the sanitary appliance to the sub-floor waste conduit.

2. The drain connector unit according to claim 1, wherein the first hollow body comprises an annular closure member at the second end wherein the closure member and the second step contain the at least one sealing element therebetween.

3. The drain connector unit according to claim 1, wherein the at least one sealing element comprises at least one fin seal including an annular body and a flexible element having a free end and being anchored at one end to the annular body, wherein the free end is configured to be displaced and deformed by action of the second hollow body relative to the first hollow body thereby creating and maintaining the interference active sealing fit between the first hollow body and the second hollow body.

4. The drain connector unit according to claim 3, wherein the at least one sealing element comprises two or more fin seals.

5. The drain connector unit according to claim 4, further comprising an annular spacer sandwiched between each fin seal.

6. The drain connector unit according to claim 1, wherein the second hollow body comprises an elongated tubular body, including an annular connector at the exposed end.

7. A drain connector installation kit comprising a drain connector unit configured to be installed with a sanitary appliance from bottom-up, wherein the drain connector unit is configured such that it can be fitted to the appliance, when the appliance is in an upright orientation; the drain connector unit comprises:

a first hollow body and a second hollow body; wherein the second hollow body is housed in the first hollow body and a second exposed end of the second hollow body facilitates sliding the second hollow body relative to the first hollow body to lengthen and shorten the drain connector unit;

wherein the drain connector unit is connectable to a sub-floor waste conduit, wherein a first end of the first hollow body is connectable to an inlet end of the sub-floor waste conduit;

a first end of the second hollow body is received at least partially within the first hollow body, wherein the second hollow body is configured to telescopically extend and retract relative to the first hollow body via a second end of the first hollow body; and at least one sealing element is contained within the first hollow body, wherein the at least one sealing element defines an interference and active sealing fit between the assembled first hollow body and the second hollow body;

wherein the first hollow body includes an internal first step acting as a stop for the second hollow body in a fully retracted position and an internal second step configured to support the at least one sealing element;

wherein the second hollow body is configured to slide relative to the first hollow body thereby extending the height of the drain connector and thereby facilitating connection of an exposed end of the second hollow body to an outlet of the sanitary appliance, wherein, in use, the second end of the second hollow body is retrievable and extendable from the first hollow body via the outlet of the sanitary appliance; and an extraction tool configured for attachment to the exposed end of the second hollow body thereby aiding extraction or retraction of the second hollow body relative to the first hollow body.

8. The drain connector installation kit according to claim 7, wherein the exposed end of the second hollow body and the extraction tool each comprise complementary fasteners to facilitate connection of the second hollow body to the extraction tool, such that the second hollow body and the extraction tool move as a unit relative to the first hollow body during extraction and retraction.

9. The drain connector installation kit according to claim 8, wherein the complementary fasteners comprise at least two radially projecting lugs on the second hollow body and at least two L-shaped slots on the extraction tool, wherein each L-shaped slot includes an open leg and a closed leg wherein the lugs are located into a mouth of the open leg, inserted into the open leg until the lug aligns with a mouth of the closed leg, rotated along the closed leg to lock the lugs against a closed end of the respective closed leg.

10. The drain connector installation kit according to claim 7, further comprising a drain key, which facilitates securing a drain flange to the exposed end of the second hollow body.

11. The drain connector installation kit according to claim 10, wherein the drain key is defined by a hollow sleeve configured to be received over at least part of the extraction tool.

12. The drain connector installation kit according to claim 10, wherein the extraction tool comprises an extraction tool body, wherein at least a portion of the extraction tool body has an external cross-sectional dimension smaller than an internal cross-sectional dimension of the drain key such that the drain key can be received over the portion of the extraction tool body.

13. The drain connector installation kit according to claim 10, wherein an external surface of the drain key is profiled to correspond with a profile of an internal surface of the drain flange such that during installation the corresponding surfaces of the drain key and the drain flange engage and rotate as a unit relative to the extraction tool.

14. The drain connector installation kit according to claim 7, wherein an exposed end of the extraction tool includes a textured surface, which facilitates gripping and holding the extraction tool during installation and removal.

* * * * *